US006349541B1

(12) United States Patent
Gruden et al.

(10) Patent No.: US 6,349,541 B1
(45) Date of Patent: Feb. 26, 2002

(54) EXHAUST SILENCER FOR AN INTERNAL COMBUSTION ENGINE AND THE METHOD OF OPERATION

(75) Inventors: Igor Gruden, Leonberg; Jochen Schäflein, Esslingen, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/443,698

(22) Filed: Nov. 19, 1999

(30) Foreign Application Priority Data

Nov. 19, 1998 (DE) ..... 198 53 359

(51) Int. Cl.[7] ..... F02B 27/02

(52) U.S. Cl. ..... 60/312; 60/314; 60/324; 181/241

(58) Field of Search ..... 181/241, 237, 181/254, 271; 60/312, 313, 314, 324

(56) References Cited

U.S. PATENT DOCUMENTS 4,079,808 A * 3/1978 Mizuno et al. ..... 181/237
4,926,636 A * 5/1990 Tadokoro et al. ..... 60/312
5,014,817 A * 5/1991 Takato et al. ..... 181/254
5,201,790 A * 4/1993 Mukai et al. ..... 60/612
5,493,857 A * 2/1996 Komatsuda et al. ..... 60/284
5,723,827 A * 3/1998 Sasaki et al. ..... 181/237
6,079,516 A * 6/2000 Pearson ..... 181/254

FOREIGN PATENT DOCUMENTS

DE 38 35 079 A1 4/1990
DE 44 16 739 A1 11/1995
DE 297 15 759 U1 4/1998

* cited by examiner

*Primary Examiner*—Thomas Denion
*Assistant Examiner*—Binh Tran
(74) *Attorney, Agent, or Firm*—Klaus J. Bach

(57) ABSTRACT

An engine exhaust silencer arrangement with a variable geometry, which is controlled by control elements in dependence of engine data. The increased exhaust noise occurring during engine operation under differing engine stroke modes is suppressed by the different geometry of the silencer arrangement.

2 Claims, 3 Drawing Sheets

EXHAUST SILENCER FOR AN INTERNAL COMBUSTION ENGINE AND THE METHOD OF OPERATION

BACKGROUND OF THE INVENTION

1. Field of the Invention

The invention relates to an internal combustion engine having an exhaust silencer or muffling system, in particular a silencer with selective variable geometry controlled in accordance with engine data or parameters and to a method of operating such an internal combustion engine having the exhaust silencer with selective variable geometry controlled in accordance with engine data or parameters.

2. Description of Related Art

German patent DE 297 15 756 U1 describes a controllable exhaust silencer in accord with control elements actuated in dependence on the operating state of the internal combustion engine (for example, rotational speed, temperature, load). As a result, the exhaust-gas stream, for different points in operation, can be set to optimum flow speeds and reflection characteristics.

A disadvantage of this solution is that certain operating states of the internal combustion engine are not taken into account. Internal combustion engines which, with the aid of variable valve control, in addition to throttle-free power regulation can also be made to operate in different multi-stroke modes. It is known that an engine can be operated in different multi-stroke modes in order to achieve a reduction in fuel consumption and pollutants. When engine operation changes between the multi-stroke modes, undamped vibrations in the exhaust-gas column or flow through a prior art exhaust silencer or muffler system can result in undesirably loud exhaust noise.

SUMMARY OF THE INVENTION

An object of the invention is thus to provide an internal combustion engine with an exhaust silencer or muffling system which achieves optimum sound damping during changing engine operations between multi-stroke modes, and to specify a method of engine operation including the exhaust silencer and muffling system. Reductions in fuel consumption and pollutants by increasing the number of strokes as engine load decreases is noticeable in diesel engines and in gasoline fuelled engines in particular.

This object is achieved by an internal combustion engine having an exhaust silencer or muffling system with selective variable geometry controlled in accordance with engine data or parameters and a method of operating such an internal combustion engine having the exhaust silencer with selective variable geometry controlled in accordance with engine data or parameters.

Since the exhaust silencer has a variable geometry which changes in co-ordination with different multi-stroke modes of engine operation as controlled by actuating elements, the muffling system can accommodate different flow and acoustic characteristics for many different numbers of engine strokes. The system inhibits undamped vibrations of the exhaust-gas column or flow, which would otherwise result in unreasonably high exhaust noise. In addition, it is also possible to have selectively variable co-ordination of the exhaust silencer geometry for different loads and rotational speeds of the engine. By virtue of the effect of the vibrations in the exhaust, it is even possible to improve, inter alia, the full-load engine behaviour.

The subject silencer muffling system co-ordinates the exhaust flow by various means. First, the volume of the silencer can be varied. Second, the cross sections of the flow through the silencer muffling system and/or the lengths of the flow can be varied. This provides a multiplicity of optimisation parameters which, in addition to the acoustic requirements, also allow flexible adaptation of the exhaust silencer muffling system to a desired design and spatial parameters as far as installation in a vehicle is concerned. The exhaust silencer muffling system is calculated in accordance with known acoustic theory, i.e., the Helmholtz resonator.

An electronic control unit, which is present in any case in modern engines, can assume the relatively straightforward additional function of the synchronous control of gas-exchange valves and controlling elements of the exhaust silencer. Serving for this purpose, inter alia, are specific characteristic maps which act activate the control elements in a functionally appropriate manner.

A particularly advantageous method of changing the number of strokes of the engine is by selectively variable valve control, especially by using electromagnetically actuated engine gas-exchange valves. These provide the advantage of quick and stepless adjustment of the valve timing. As a result, in addition to the variation of the number of strokes, it is also possible to realise throttle-free engine regulation and stepless regulation of the compression.

In the silencer muffling system, possible flow control elements are control flaps, control valves and control slides, the selection of which contributes to the flexible solution to the problems of co-ordinating the operation of the exhaust silencer with different engine operations.

Arranging the controllable exhaust silencer downstream of any exhaust-treatment systems, as seen in the flow direction, is advantageous. Examples of an exhaust-treatment device or system is a particle filters (for diesel engines) and/or a catalytic converters.

BRIEF DESCRIPTION OF THE DRAWINGS

Exemplary embodiments of the subject invention are explained in more detail hereinafter with reference to the drawing, in which.

DESCRIPTION OF THE PREFERRED EMBODIMENTS

Figure 1:
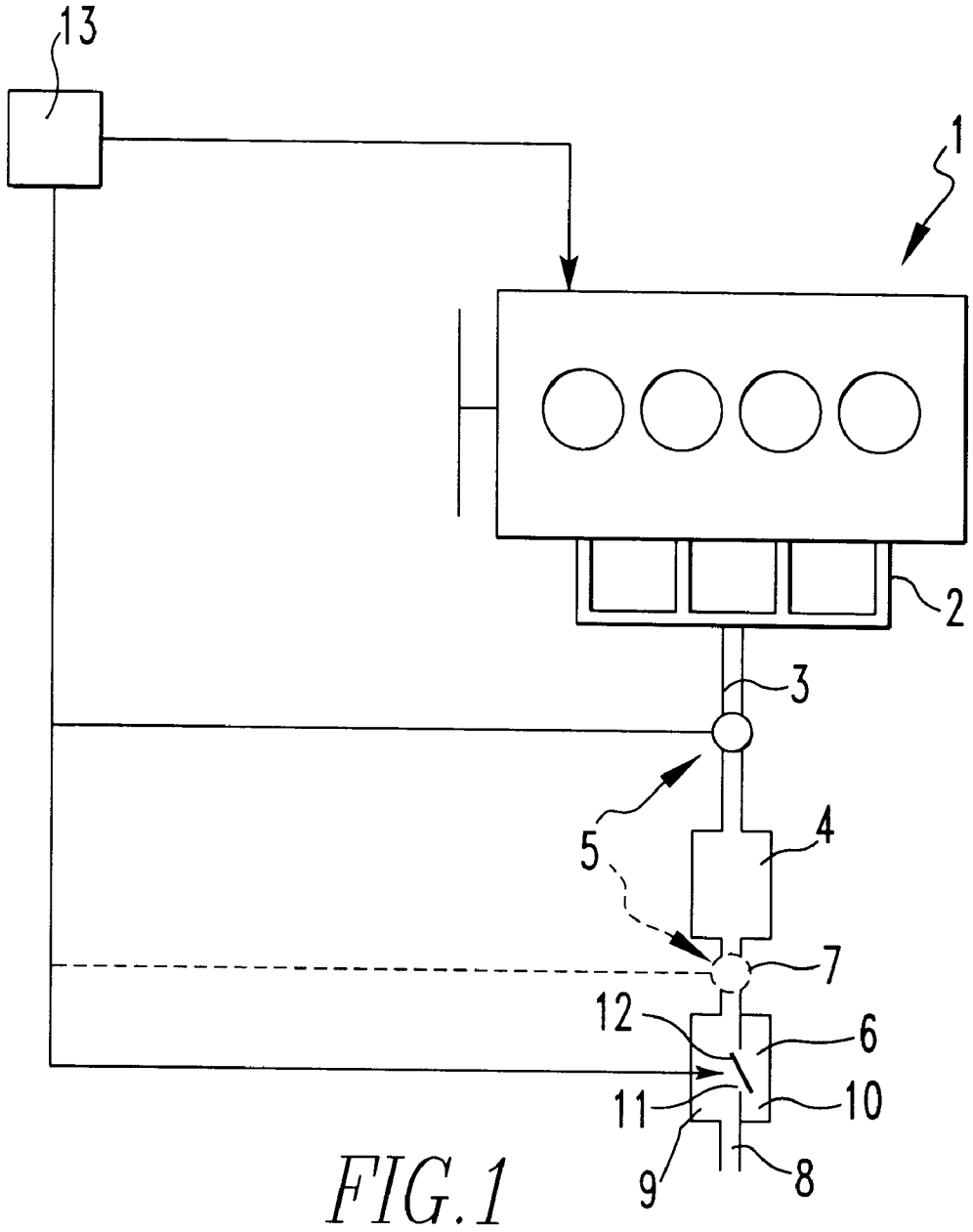
FIG. 1 shows a schematically illustrated internal combustion engine having an exhaust muffling silencer, of which the volume is variable.

In FIG. 1 a four-cylinder internal combustion engine 1 is illustrated which has an exhaust manifold 2 which combines the exhaust-gas streams from individual cylinders. The exhaust manifold 2 is adjoined by an exhaust-gas pipe or tube 3 which leads to a catalytic converter 4. Typically, a lambda probe or oxygen sensor device 5 may be located in the exhaust-gas pipe 3 for monitoring the composition of the fuel/air mixture discharged from the internal combustion engine 1. In this case, the lambda probe 5 may be arranged upstream, as seen in the flow direction of the exhaust. As illustrated by dashed lines, an alternate location of the probe may be in the exhaust pipe 7 downstream of the catalytic converter 4.

Downstream of the catalytic converter 4 in the flow direction, an exhaust silencer 6 is connected to the catalytic converter 4 by an exhaust pipe or tube 7. Likewise, downstream of the exhaust silencer 6, an exhaust pipe or tube 8 carries exhaust gas into the open or atmosphere.

The enclosure forming the exhaust silencer 6 defines a first volume 9 and a second volume 10 which volumes are connected by an opening 11. The opening can be closed by a movable control element, e.g. a control flap 12. The opening and closing of the control flap 12 can be controlled by an electronic control unit (ECU) 13. The ECU 13 also controls the air/fuel mixture formation via a signal from the lambda probe 5 and activation/deactivation of fuel injectors (not shown), one for each engine cylinder. It is the ECU that controls the activation/deactivation of the engine's intake and exhaust valves to effect various different multi-stroke modes of the internal combustion engine 1. The ECU 12 accesses various characteristic maps related to engine load, rotational speed and multi-stroke modes. The silencer's control flap is controlled, as required, and in accordance with the particular multi-stroke mode in which the engine is operating. Preferably, an electromechanical actuating element is provided for moving the control flap 12.

The selective multi-stroke mode of the engine is controlled by variable actuation of the engine's gas-exchange (intake and exhaust) valves. This control may take place via controllable drag levers or rocker levers. The use of electromagnetically controlled valves (EMVC), by means of which the control times of the gas-exchange valves can be varied from operating cycle to operating cycle, will provide a particularly quick and flexible arrangement.

Figure 2:
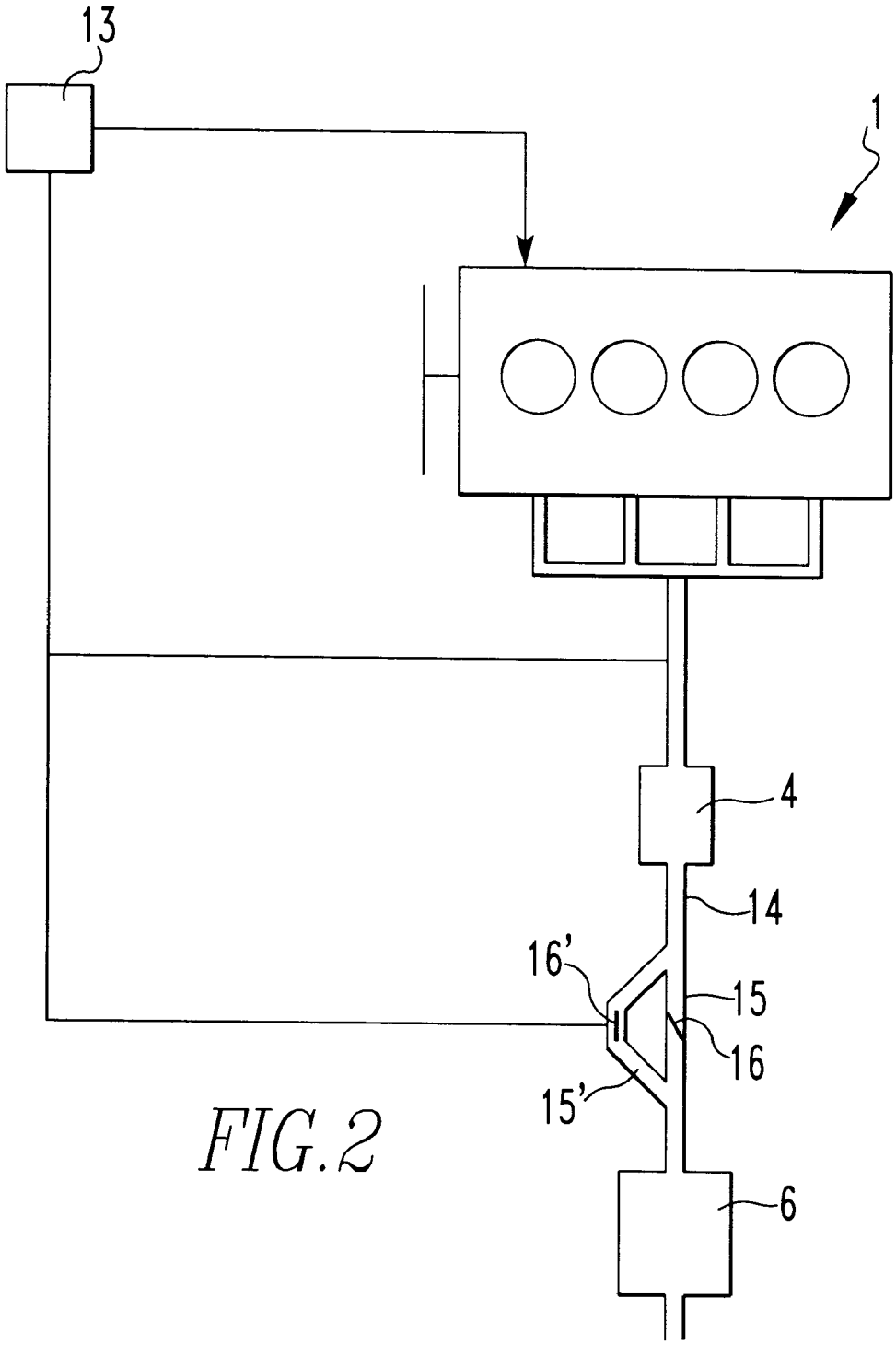
FIG. 2 shows the internal combustion engine according to FIG. 1, having an exhaust muffling silencer, with which the exhaust carrying conduit has a variable length.

In FIG. 2, the same internal combustion engine 1 as in FIG. 1 is illustrated. A catalytic converter 4 located downstream of the engine and an exhaust silencer 6 is located downstream of the catalytic converter 4 are illustrated. The difference from FIG. 1 is to be found in the exhaust-gas pipe or tube 7, which is designed as a variable-length exhaust-gas pipe 14 with two branches 15, 15' of different lengths. Located in each branch 15, 15' is a control flap or valve 16, 16', which can be activated/deactivated in any combination. These control flaps 16, 16' are opened and closed in a reciprocal manner in response to control signals from the electronic control unit 13, which is connected to the control-flap drives.

Figure 3:
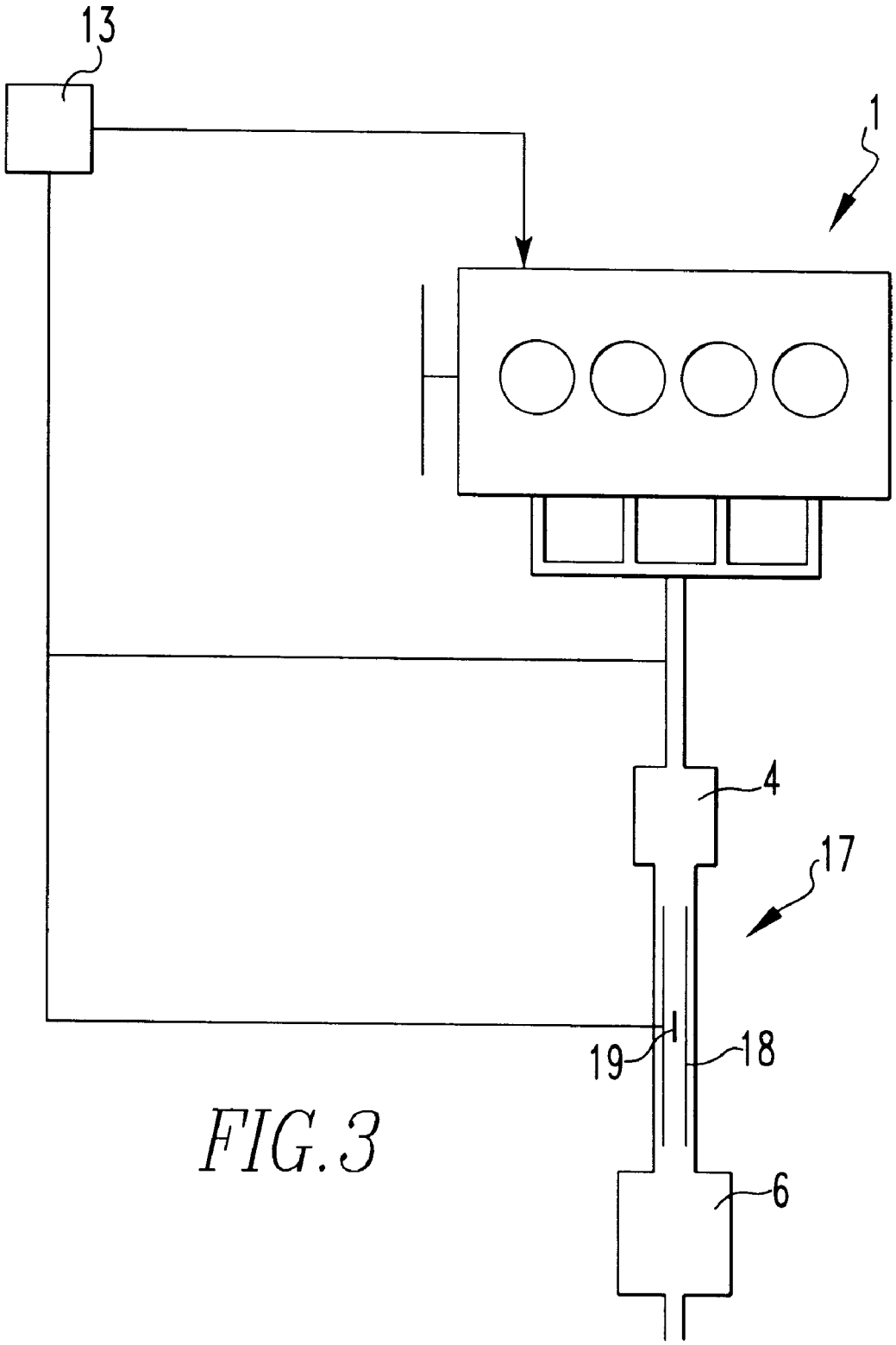
FIG. 3 shows the internal combustion engine according to FIG. 1, having an exhaust muffling silencer, with which the exhaust carrying conduit has a variable cross section.

In FIG. 3, the same internal combustion engine 1 as in FIGS. 1 and 2 is shown, but with an exhaust-gas pipe or tube 17 which has a variable cross section. Specifically, the exhaust-gas pipe is in the form of concentric outer and inner pipes 17 and 18 respectively. Inner tube 18 has a control flap 19 therein and which can close said inner pipe and thus reduce the cross-sectional area or through-passage for flow of exhaust-gas through the pipe 17. Opening and closing of the control flap 19 is controlled by the electronic control unit 13.

The arrangement according to the invention described above functions as follows: in the exemplary embodiment, the internal combustion engine 1 can be designed to operate as a two-stroke engine when maximum load and power are needed. The engine may operate as a gasoline, spark ignited engine, as described above or as a compression ignited diesel engine. When a diesel engine is used, a particle filter may be provided upstream of the catalytic converter 4 or may replace the catalytic converter. In either case, the design of the exhaust silencer muffling system 6 is the same.

When the engine is operating at high speed and/or in a high load range, it operates in two-stroke mode. As the load decreases, the overall thermal efficiency decreases. However, if in response to a lower load, selective valving and fuel injection are deactivated, then the engine can be made to operate in a four stroke mode which would improve the engine's thermal efficiency. As the load further is decreased, the internal combustion engine may be then operated in a six-stroke mode, then an eight-stroke mode, and so on. This results in maintaining the load of the engine's remaining operating strokes at a high level. However, with the intervals between individual exhaust surges increasing, in comparison with two-stroke operation, a higher level of exhaust noise will typically be created. This high level of resulting exhaust noise is combated by control of the control flaps 12 (in FIG. 1), 16, 16' (in FIG. 2), and 19 (in FIG. 3) which are controlled synchronously with the change in stroke mode. These control flaps bring about, individually or in combination, a new co-ordination of the exhaust silencer 6, which results in the desired noise reduction. Also, the resulting pulsation of the exhaust-gas flow can be utilised to improve the scavenging of the combustion chamber and thus to improve the efficiency of the engine, all while reducing the exhaust-gas emissions.

Of course, various combinations of the methods explained above are also possible without falling outside the scope of the following claims which define the invention.

What is claimed is:

1. An internal combustion engine having a two stroke mode or a four stroke mode selective capacity, to operate in more than one stroke modes, and including an electronic control unit which has operational characteristic maps for load, engine speed, and stoke modes, an improved exhaust gas silencer apparatus having variable operational characteristics conforming to different stroke modes of the associated engine, the improved silencer comprising:

a silencer enclosure having an apertured wall member separating the interior into first and second volumetric chambers;

said silencer enclosure having an inlet to said first chamber for receiving exhaust gas from the engine and an outlet from said first chamber for discharging exhaust gas; and a valve member normally covering said aperture in said wall member when the associated engine is operated in a first stroke mode and with the valve member being selectively, movable to open said aperture in said wall member when the associated engine is operated in a second stroke mode.

2. An internal combustion engine having a two stroke mode or a four stroke mode selective capacity to operate in more than one stroke modes, and including an electronic control unit which has operational characteristic maps for different stoke modes, and further having a silencer enclosure with two volumetric spaces separated by an apertured wall, one space for exhaust flow through the enclosure and a second closed space communicating with the first space through the aperture and including a selectively openable valve and valve actuator associated with the wall aperture to selectively expose the second closed space with the first space, an improved method of silencing differing exhaust gas flow characteristics according to different stroke modes of the associated engine comprising:

receiving operational data into the electronic control unit the particular stroke mode in which the associated engine is operating; and creating and sending a signal to the valve actuator for controlling the opening of the aperture in the wall between the first space and the second space.

* * * * *